US006769257B2

(12) United States Patent
Kondo et al.

(10) Patent No.: US 6,769,257 B2
(45) Date of Patent: Aug. 3, 2004

(54) TRANSITION PIECE OUTLET STRUCTURE ENABLING TO REDUCE THE TEMPERATURE, AND A TRANSITION PIECE, A COMBUSTOR AND A GAS TURBINE PROVIDING THE ABOVE OUTPUT STRUCTURE

(75) Inventors: Mitsuru Kondo, Takasago (JP); Satoshi Hada, Takasago (JP); Katsunori Tanaka, Takasago (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 36 days.

(21) Appl. No.: 10/075,461

(22) Filed: Feb. 15, 2002

(65) Prior Publication Data

US 2002/0112483 A1 Aug. 22, 2002

(30) Foreign Application Priority Data

Feb. 16, 2001 (JP) ..... 2001-040220

(51) Int. Cl.[7] ..... F02C 1/00; F02G 3/00

(52) U.S. Cl. ..... 60/730; 60/806; 60/736; 60/752

(58) Field of Search ..... 60/806, 736, 752, 60/730

(56) References Cited

U.S. PATENT DOCUMENTS

| | | | | | |
|---|---|---|---|---|---|
| 2,608,057 | A | | 8/1952 | Boyd et al. | |
| 3,652,181 | A | * | 3/1972 | Wilhelm, Jr. | 415/117 |
| 4,018,046 | A | * | 4/1977 | Hurley | 60/264 |
| 4,195,474 | A | * | 4/1980 | Bintz et al. | 60/730 |
| 5,414,999 | A | * | 5/1995 | Barnes | 60/722 |
| 5,706,646 | A | * | 1/1998 | Wilde et al. | 60/39.37 |
| 5,749,218 | A | * | 5/1998 | Cromer et al. | 60/796 |
| 5,761,898 | A | * | 6/1998 | Barnes et al. | 60/799 |
| 5,819,525 | A | * | 10/1998 | Gaul et al. | 60/806 |
| 5,906,093 | A | * | 5/1999 | Coslow et al. | 60/777 |
| 6,081,950 | A | * | 7/2000 | Moeller | 60/752 |
| 6,220,036 | B1 | * | 4/2001 | Inada et al. | 10/75 |
| 6,370,862 | B1 | * | 4/2002 | Cheng | 60/775 |
| 6,494,044 | B1 | * | 12/2002 | Bland | 60/772 |
| 6,553,766 | B2 | * | 4/2003 | Shimizu et al. | 60/752 |
| 6,568,187 | B1 | * | 5/2003 | Jorgensen et al. | 60/752 |
| 6,571,560 | B2 | * | 6/2003 | Tatsumi et al. | 60/753 |

FOREIGN PATENT DOCUMENTS

| | | |
|---|---|---|
| EP | 0 559 420 | 9/1993 |
| EP | 1 046 787 | 10/2000 |
| EP | 1 052 375 | 11/2000 |
| EP | 1 146 289 | 10/2001 |
| JP | 2-308926 | 12/1990 |
| JP | 3110338 | 9/2000 |
| WO | WO 97/14875 | 4/1997 |

OTHER PUBLICATIONS

Patent Abstracts of Japan, JP 11–022411, Jan. 26, 1999.
Patent Abstracts of Japan, JP 10–196312, Jul. 28, 1998.

* cited by examiner

*Primary Examiner*—Charles G. Freay
*Assistant Examiner*—William H. Rodriguez
(74) *Attorney, Agent, or Firm*—Oblon, Spivak, McClelland, Maier & Neustadt, P.C.

(57) ABSTRACT

A gas turbine combustor transition piece outlet structure enabling a reduction in the temperature difference of a flange formed at the transition piece outlet. A flange is formed with a cooling medium channel along the inner circumference, cooling medium channels along the left and right side surfaces, and heating medium channels along the top and bottom surfaces. By cooling the inner circumference or the side surfaces of the flange by a cooling medium or heating the top and bottom surfaces of the flange by a heating medium, the temperature difference of the flange is reduced. Note that as the cooling medium, it is possible to use compressed air, low temperature steam, or fuel, while as the heating medium, it is possible to use high temperature steam or combustion gas.

15 Claims, 12 Drawing Sheets

TRANSITION PIECE OUTLET STRUCTURE ENABLING TO REDUCE THE TEMPERATURE, AND A TRANSITION PIECE, A COMBUSTOR AND A GAS TURBINE PROVIDING THE ABOVE OUTPUT STRUCTURE

BACKGROUND OF THE INVENTION

1. Field of the Invention

The present invention relates to a gas turbine, more particularly relates to a transition piece outlet structure enabling a reduction of the temperature difference, and a transition piece, a combustor and a gas turbine having the above outlet structure.

2. Description of the Related Art

A gas turbine is a one kind of prime movers which is comprised of a compressor for compressing air, a combustor for generating high pressure and high temperature combustion gas by burning fuel with the compressed air, and a turbine driven by the combustion gas.

It is important to reduce the thermal stress, which acts on the combustor comprised of a nozzle for injecting fuel and a transition piece for supplying exhaust gas to a turbine in order to improve the reliability of the gas turbine.

Therefore, a technique for cooling the combustion chamber of the combustor with steam (see Japanese Patent Publication No. 3110338) and a technique for cooling the transition piece with air (see Japanese Unexamined Patent Publication No. 2-308926) are already proposed.

Further, it is necessary to reduce the radial temperature difference on the flange, which is used for connecting the transition piece to the turbine (see FIG. 12).

Exhaust gas exhausted from the combustor flows through the transition piece, so occurrence of a temperature difference in the flange of the outlet of the transition piece cannot be avoided. Therefore, cracks are liable to occur due to thermal stress in the corners of the transition piece. An increase of the frequency of maintenance and inspection is therefore unavoidable.

SUMMARY OF THE INVENTION

An object of the present invention is to provide a transition piece outlet structure able to reduce the temperature difference of a flange formed at the transition piece outlet, and the transition piece, the combustor and the gas turbine providing the above outlet structure.

To attain the above object, according to a first aspect of the present invention, there is provided a gas turbine combustor transition piece outlet structure providing a flange formed at a gas turbine transition piece outlet with a temperature difference reducing means for reducing a temperature difference between an inside and outside of said flange.

Note that the temperature difference reducing means is at least one of a cooling medium channel formed along an inner circumference of said flange, a cooling medium channel formed along a contact surface with an adjoining flange, and a heating medium channel formed along a surface not contacting an adjoining flange.

Further, the cooling medium is any of compressed air, low temperature steam, or fuel, while the heating medium is any of a combustion gas or high temperature steam.

In the present invention, the temperature difference from the inside to the outside of the flange of the transition piece outlet is reduced.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
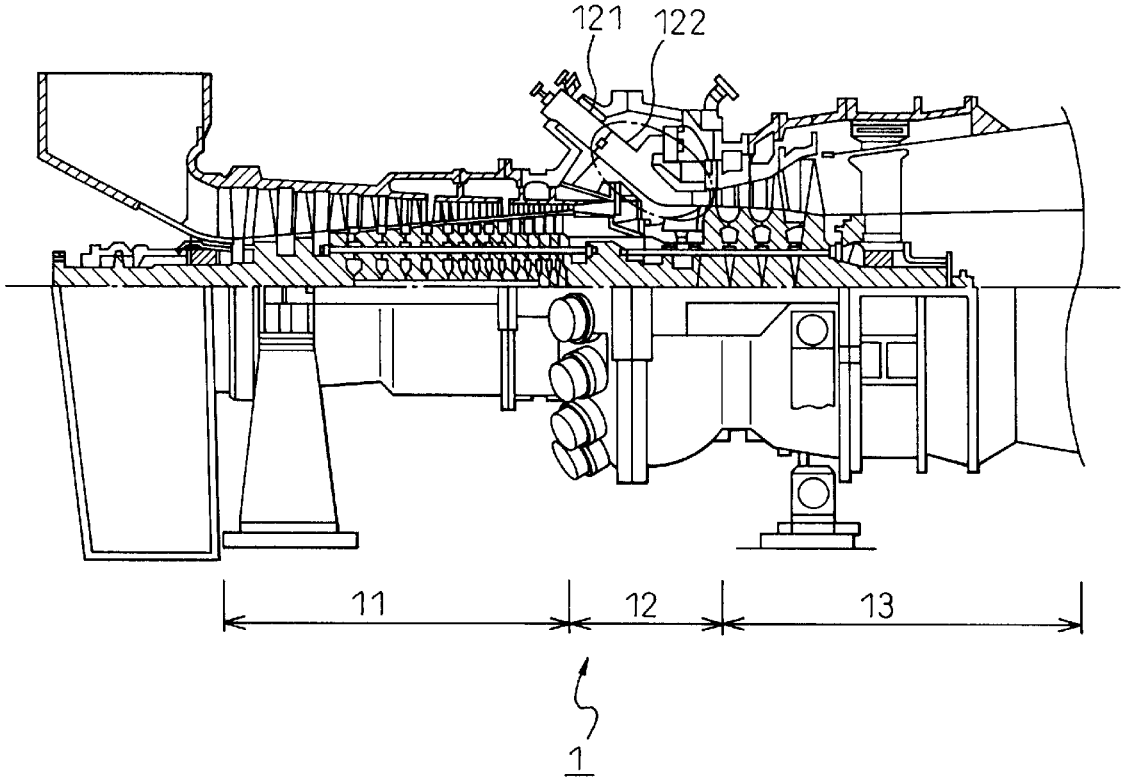
FIG. 1 is a sectional view of the shape of a gas turbine.

FIG. 1 is a sectional view of the shape of a gas turbine. The gas turbine 1 is comprised of an air compressor 11, a combustor 12, and a turbine part 13.

The combustor 12 is comprised of a combustion tube 121 inserted around the approximate center of the gas turbine 1 and a transition piece 122 leading combustion gas to the turbine part 13.

Figure 2:
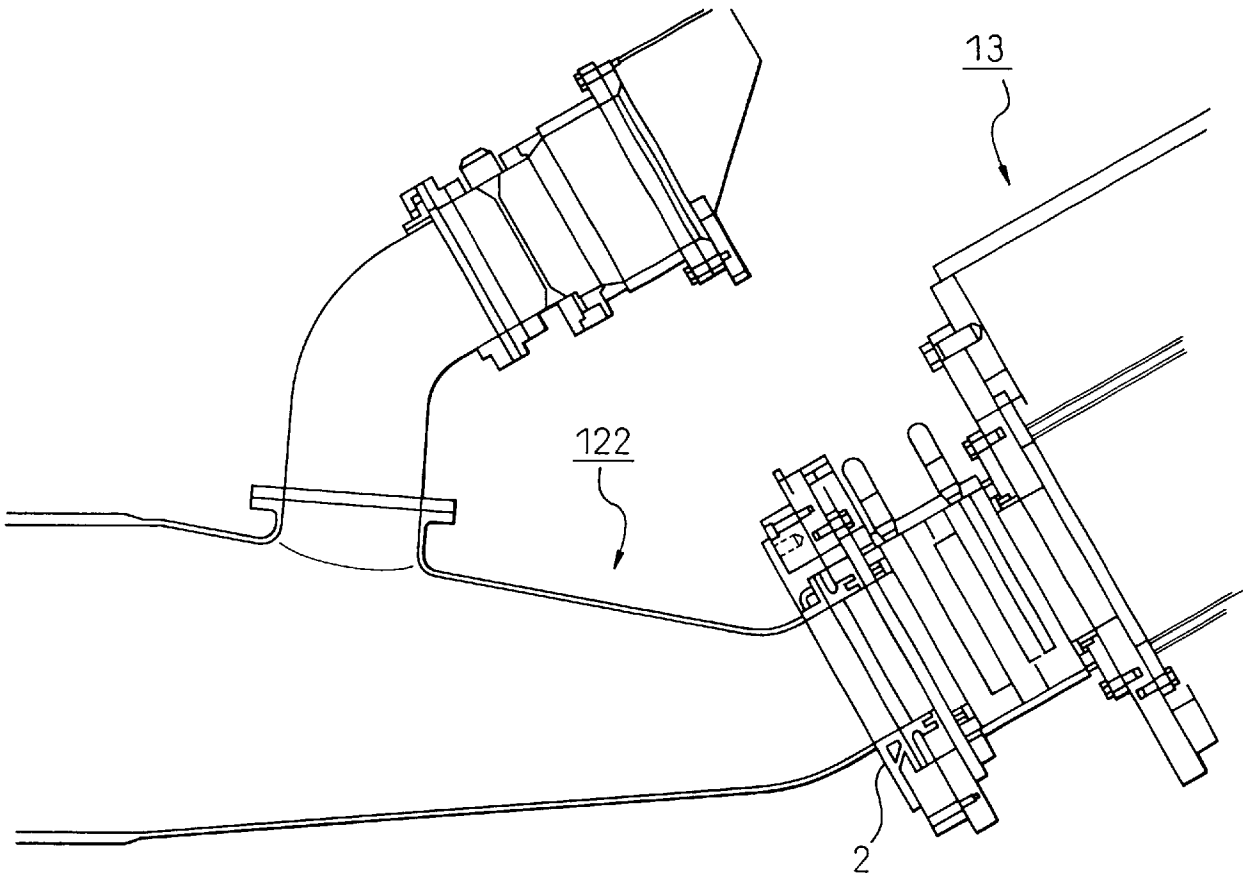
FIG. 2 is an enlarged view of a transition piece.

FIG. 2 is an enlarged view of a transition piece (portion surrounded by one-dot chain line in FIG. 1). A flange 2 is formed at the outlet portion of the transition piece 122 and is arranged facing a flange formed at the nozzle inlet (not shown) of the turbine part 13.

The transition piece 122 is exposed to the high temperature combustion gas flowing through its inside, so air compressed at the air compressor 11 is supplied to cool the outside of the transition piece 122.

Preferred embodiments of the present invention will be described in detail below while referring to the attached figures.

The following three methods may be considered for reducing the temperature difference in the radial direction of the flange 2:

(1) Cooling the inner circumference of the flange 2 by a medium to reduce the heat caused by the combustion gas flowing inside the transition piece. In this case, a channel of a sectional diameter of 1 to 3 mm is formed along the inner circumference of the flange to carry the cooling medium.

Figure 3:
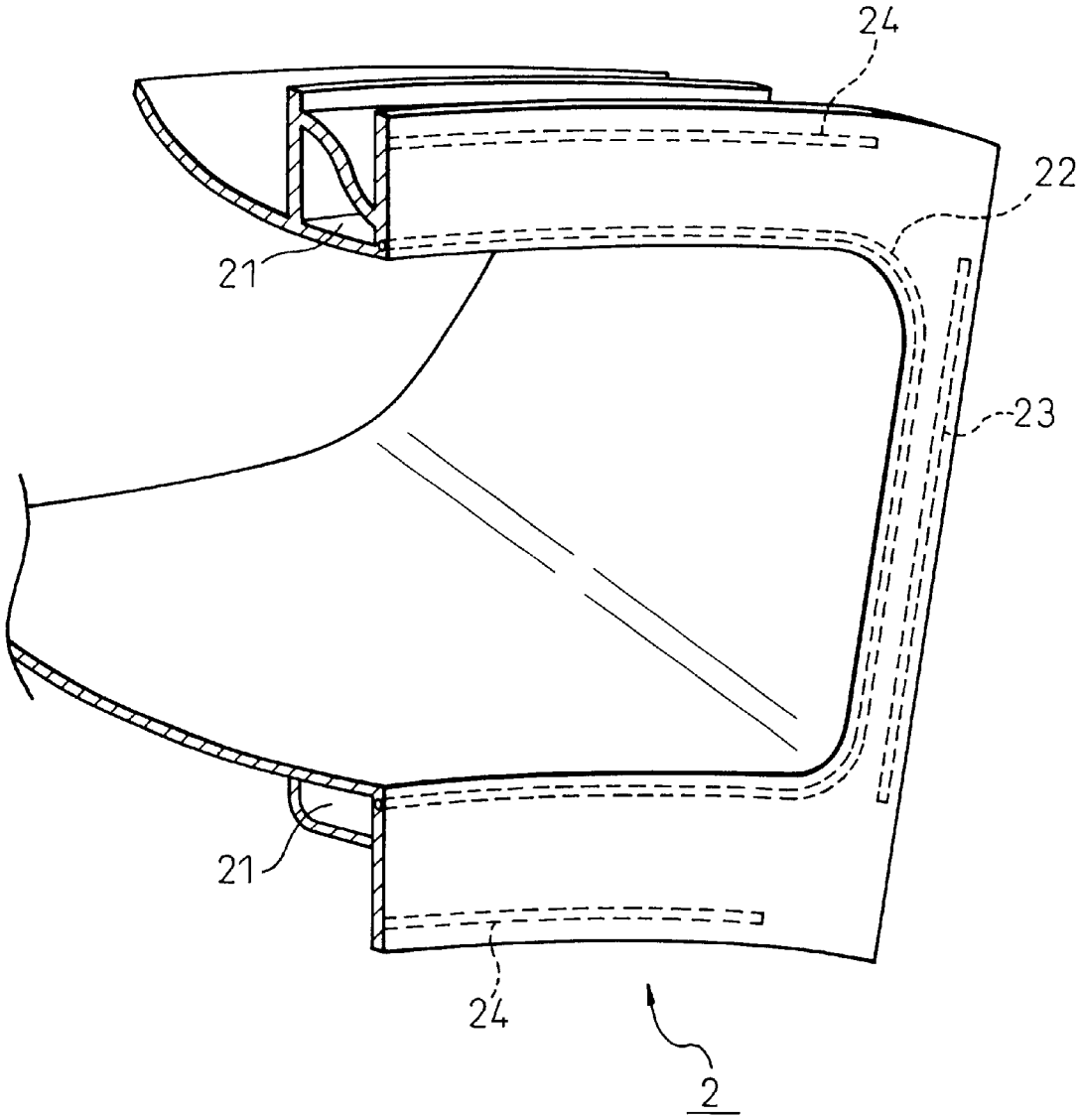
FIG. 3 is a perspective view of a transition piece outlet structure according to the present invention.

(2) Cooling the side surfaces of the flange 2 by a medium to reduce the heat caused by the combustion gas at the side flange surfaces (hatched part in FIG. 3). In this case, channels are formed along the left and right side surfaces of the flange to carry the cooling medium.

(3) Heating the surfaces of the flange 2 not contacting the adjoining flange (below, "top and bottom surfaces") by a medium to achieve uniform temperature in the radial direction. In this case, channels are formed along the top and bottom surfaces of the flange to carry the heating medium.

FIG. 3 is a perspective view of a transition piece outlet structure according to the present invention. Reference numeral 21 indicates a cooling medium channel, which extends from the beginning of the transition piece to its exit to cool the transition piece, and the flange arranged at the exit of the transition piece. Reference numeral 22 indicates a cooling medium channel formed along the inner circumference of the flange, 23 cooling medium channels formed along the left and right side surfaces of the flange, and 24 heating medium channels formed along the top and bottom surfaces of the flange.

Further, as the cooling medium, it is possible to use air, steam, or fuel. As the heating medium, it is possible to use steam or combustion gas.

Figure 4:
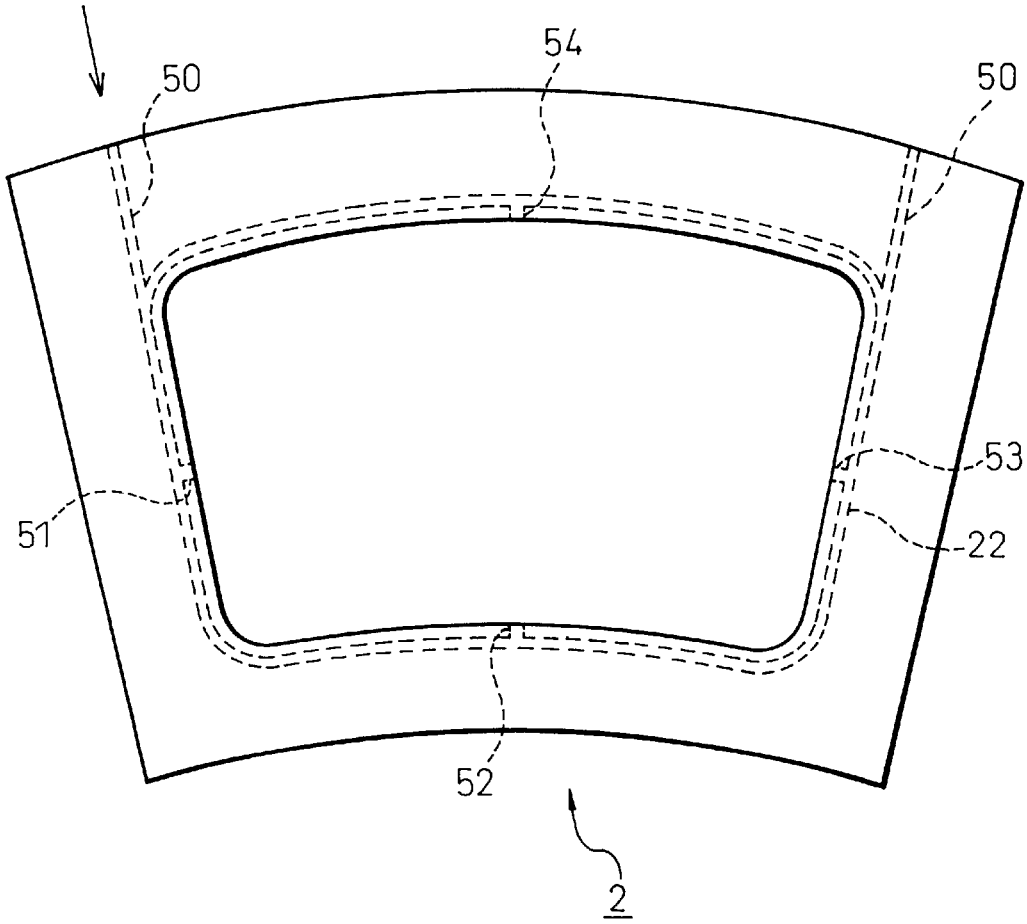
FIG. 4 is a structural view of a first embodiment.

FIG. 4 is a structural view of a first embodiment of the transition piece outlet structure according to the present invention and shows the case of using compressed air as the cooling medium flowing through a channel 22 along the inner circumference of the flange 2.

The compressed air is supplied from a compressed air source (not shown) through a feed channel 50 formed from the top surface of the flange 2. Note that as the compressed air source, it is advantageous to make use of an air compressor 11 of the gas turbine.

Further, the channel 22 is connected to for example four discharge channels 51 to 54 opening at the inside of the transition piece. Therefore, the compressed air flowing through the channel 22 and cooling the inner circumference of the flange 2 is discharged into the combustion gas flowing through the inside of the transition piece through the discharge channels 51 to 54.

Figure 5:
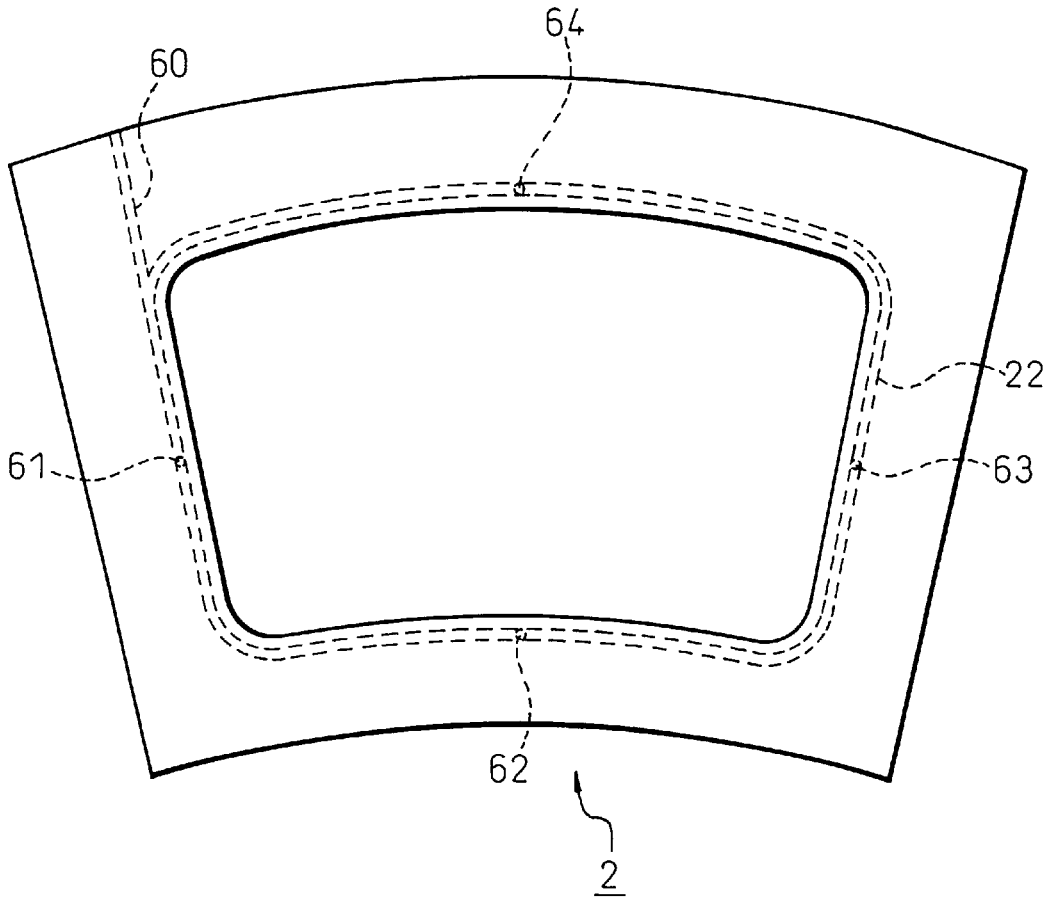
FIG. 5 is a structural view of a second embodiment.

FIG. 5 is a structural view of a second embodiment of the transition piece outlet structure according to the present invention and shows the case of using steam as the cooling medium flowing through a channel 22 along the inner circumference of the flange 2.

The steam is supplied from a steam source (not shown) through a feed channel 60 formed from the top surface of the flange 2. Note that as the steam source, it is advantageous to make use of the source of the steam for cooling the gas turbine.

Further, the channel 22 is connected to for example four discharge channels 61 to 64 opening at a steam channel 21 at the back surface of the flange 2. Therefore, the steam flowing through the channel 22 and cooling the inner circumference of the flange is discharged to the steam channel 21 of the back surface of the flange 2 through the discharge channels 61 to 64.

When a gas turbine having the above-mentioned transition piece is applied to a combined cycle plant comprised of the gas turbine and a steam turbine, the generating efficiency can be more improved, because heat energy exhausted from the exit of the transition piece can be recovered as motive power and/or electric power by rotating a high pressure turbine by steam exhausted from discharge channels 61 to 64, and heated at a residual heat recovery boiler (not shown).

Figure 6:
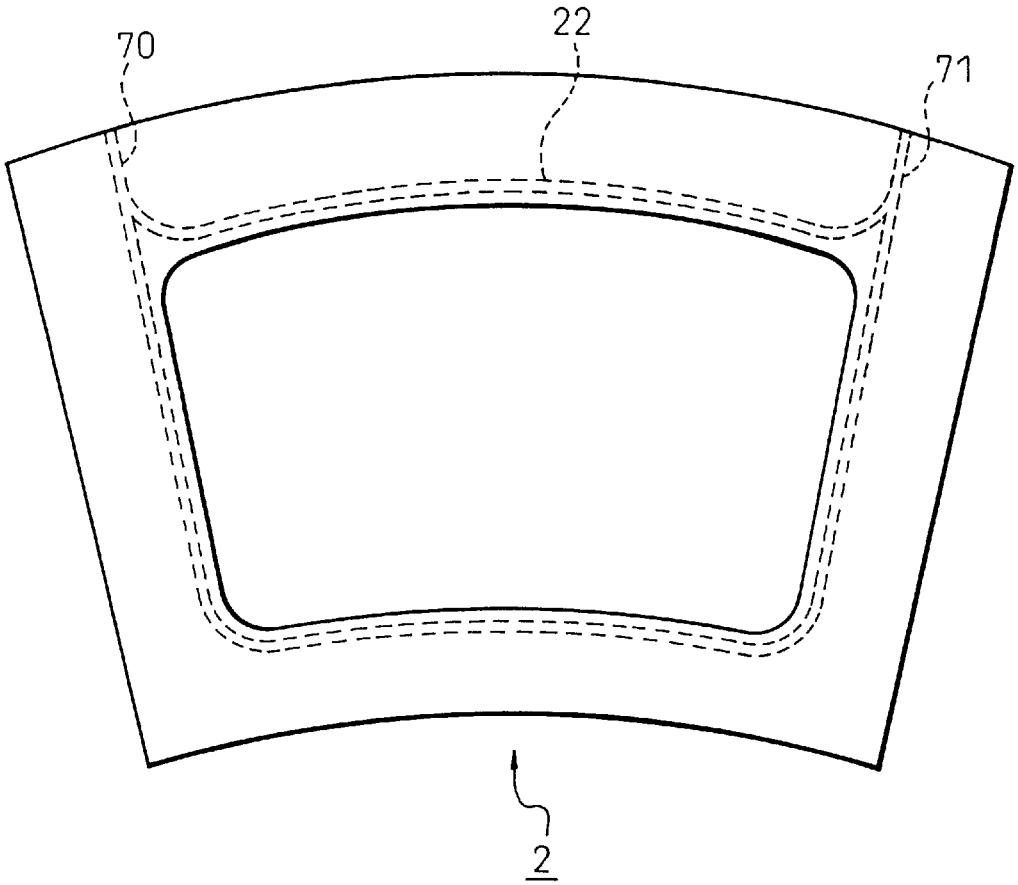
FIG. 6 is a structural view of a third embodiment.

FIG. 6 is a structural view of a third embodiment of the transition piece outlet structure according to the present invention and shows the case of using fuel as the cooling medium flowing through a channel 22 along the inner circumference of the flange 2.

The fuel is supplied from a fuel tank through a feed channel 70 formed for example at the left side on the top surface of the flange 2.

Further, the channel 22 is connected to a discharge gas channel 71 formed at the right side of the top surface of the flange 2. Therefore, the fuel flowing through the channel 22 and cooling the inner circumference of the flange is discharged outside of the flange 2 through the discharge channel 71. Note that the discharged fuel can of course be used as fuel of the gas turbine.

In this case, the efficiency of the gas turbine can be improved, because enthalpy of fuel supplied to the combustor is increased.

Figure 7:
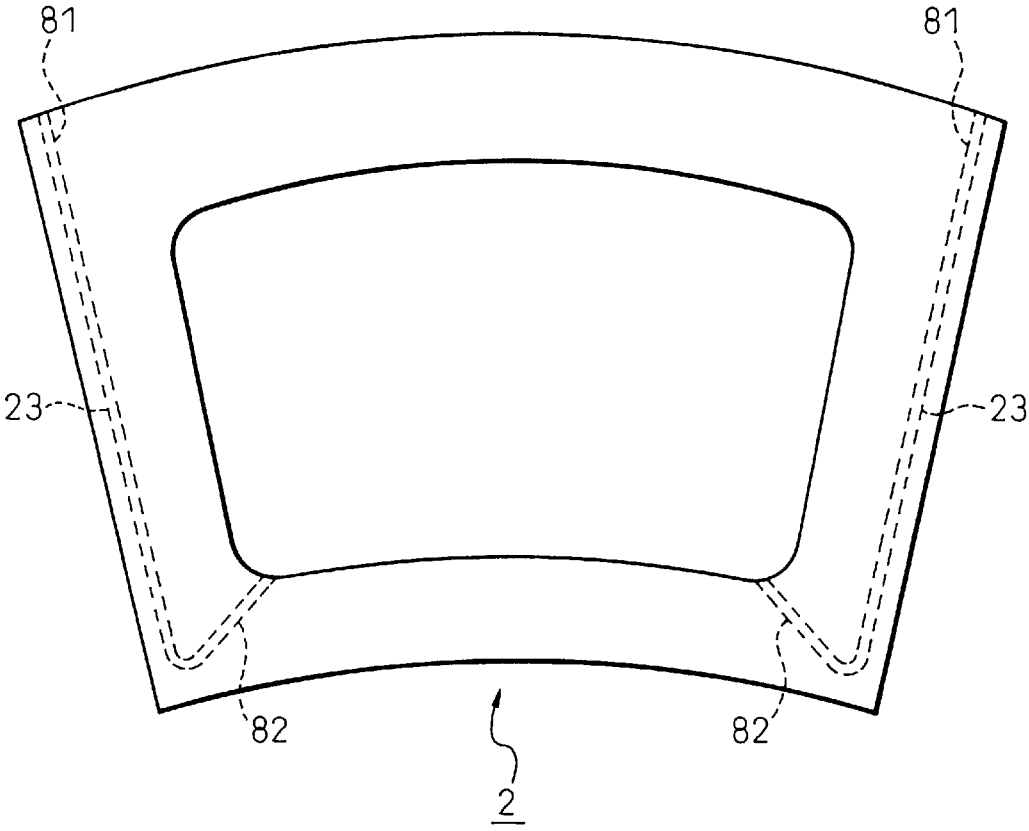
FIG. 7 is a structural view of a fourth embodiment.

FIG. 7 is a structural view of a fourth embodiment of the transition piece outlet structure according to the present invention and shows the case of using air as the cooling medium flowing through channels 23 along the side surfaces of the flange 2.

That is, the compressed air is supplied from two feed channels 81 opening at the top surface of the flange 2 and is discharged into the combustion gas flowing through the inside of the flange from discharge channels 82 opening at the inside of the flange 2.

This embodiment becomes more effective, when this embodiment is combined with the second embodiment shown in FIG. 5, and costs cheaply because any special equipment are not necessary. Further, this embodiment can improve the life and reliability of a moving blade due to low temperature at the root of the hub of a moving blade, because the discharge channels 82 are arranged at the low inner edge of the flange 2.

Figure 8:
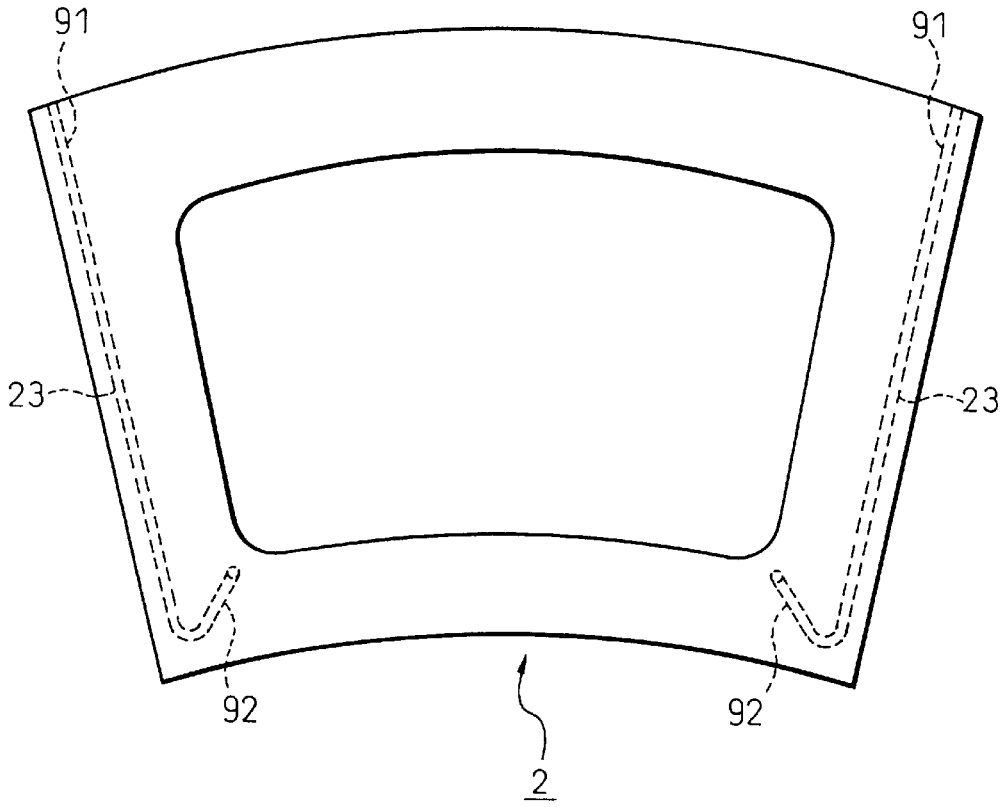
FIG. 8 is a structural view of a fifth embodiment.

FIG. 8 is a structural view of a fifth embodiment of the transition piece outlet structure according to the present invention and shows the case of using steam as the cooling medium flowing through channels 23 along the side surfaces of the flange 2.

That is, the steam is supplied from two feed channels 91 opening at the top surface of the flange 2 and is discharged into the steam flowing through the steam channels 21 from discharge channels 92 opening at the steam channels 21 behind the flange 2.

This embodiment becomes more effective, when this embodiment is combined with the third embodiment shown in FIG. 6. When a gas turbine having the above-mentioned transition piece is applied to a combined cycle plant comprised of the gas turbine and a steam turbine, the generating efficiency can be more improved, because heat energy exhausted from the exit of the transition piece can be recovered as motive power and/or electric power by rotating a high pressure turbine by steam exhausted from discharge channels 92, and heated at a residual heat recovery boiler (not shown).

Figure 9:
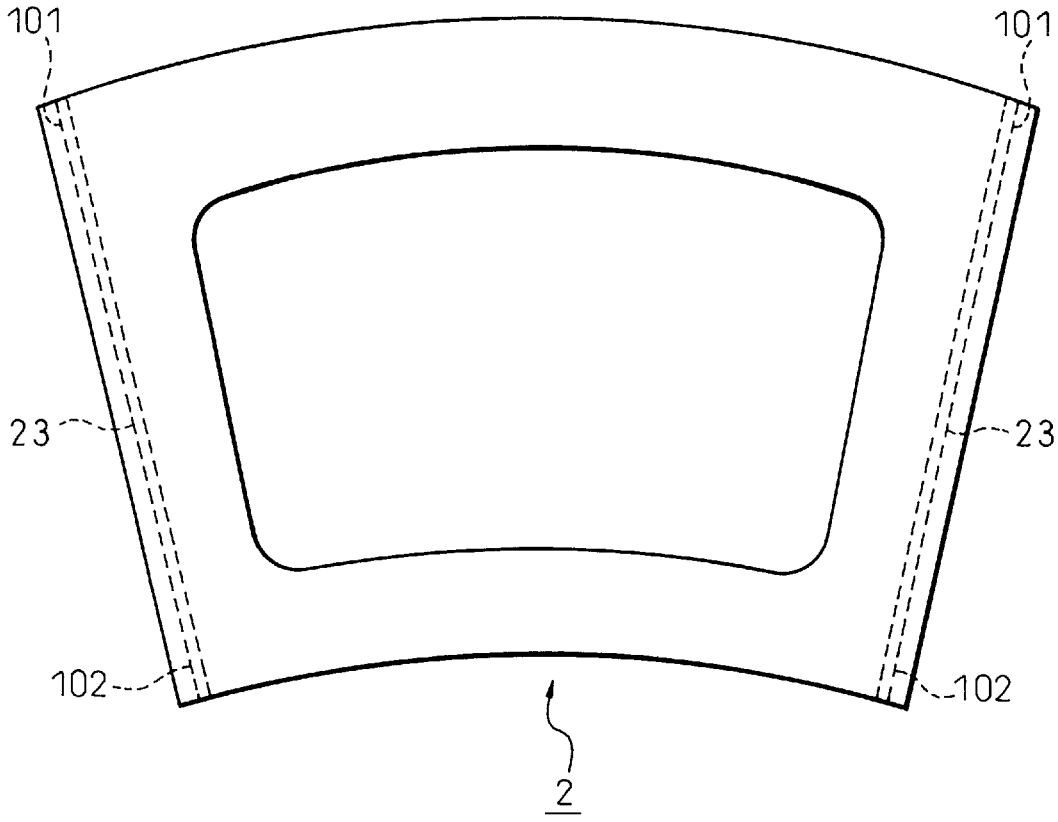
FIG. 9 is a structural view of a sixth embodiment.

FIG. 9 is a structural view of a sixth embodiment of the transition piece outlet structure according to the present invention and shows the case of using fuel as the cooling medium flowing through channels 22 along the side surfaces of the flange 2.

That is, the fuel is supplied from two feed channels 101 opening at the top surface of the flange 2, is discharged from discharge channels 102 opening at the bottom surface of the flange 2, and is used as fuel of the gas turbine.

Note that it is also possible to provide both of the channel 22 of the flange inner circumference and the channels 23 of the flange side surfaces to cool both the flange inner circumference and side surface.

This embodiment becomes more effective, when this embodiment is combined with the fourth embodiment shown in FIG. 7. The efficiency of the gas turbine can be improved, because the thermal stress is less and the efficiency of heat recovery is more effective than the fourth embodiment.

Figure 10:
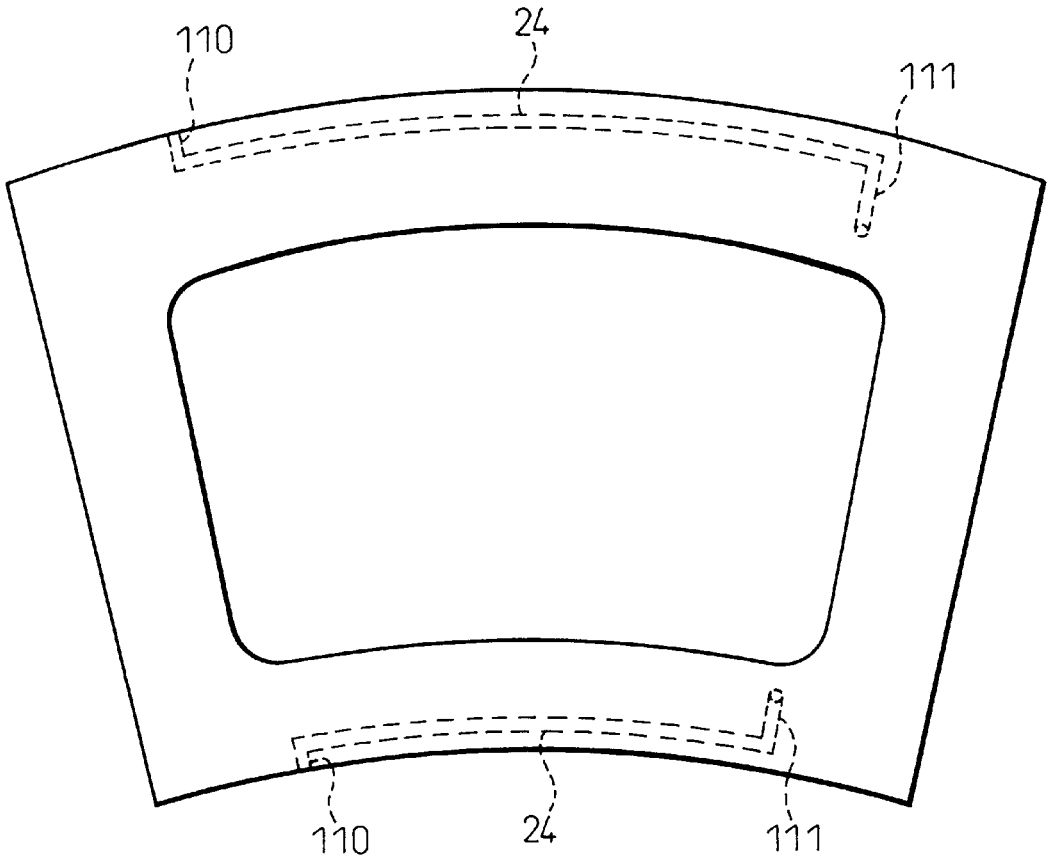
FIG. 10 is a structural view of a seventh embodiment.

FIG. 10 is a structural view of a seventh embodiment of a transition piece outlet structure according to the present invention and shows the case of using high temperature steam as the heating medium flowing through channels 24 along the top and bottom surfaces of the flange 24.

That is, the channels 24 are connected to steam feed channels 110 opening at the top and bottom surfaces of the flange and steam discharge channels 111 communicating with a steam channel 21 on the back surface of the flange.

That is, the high temperature steam fed from the steam source (not shown) is guided through the steam feed channels 110 to the channels 24, flows through the channels 24 while heating the top and bottom surfaces of the flange, and is discharged through the steam discharge channels 111 to the steam channel 21.

This embodiment becomes more effective, when this embodiment is combined with the third embodiment shown in FIG. 6 or the fifth embodiments in FIG. 8. When a gas turbine having the above-mentioned transition piece is applied to a combined cycle plant comprised of the gas turbine and a steam turbine, the generating efficiency can be more improved, because heat energy exhausted from the exit of the transition piece can be recovered as motive power and/or electric power by rotating a high pressure turbine by steam exhausted from discharge channels 92, and at a residual heat recovery boiler (not shown).

Figure 11:
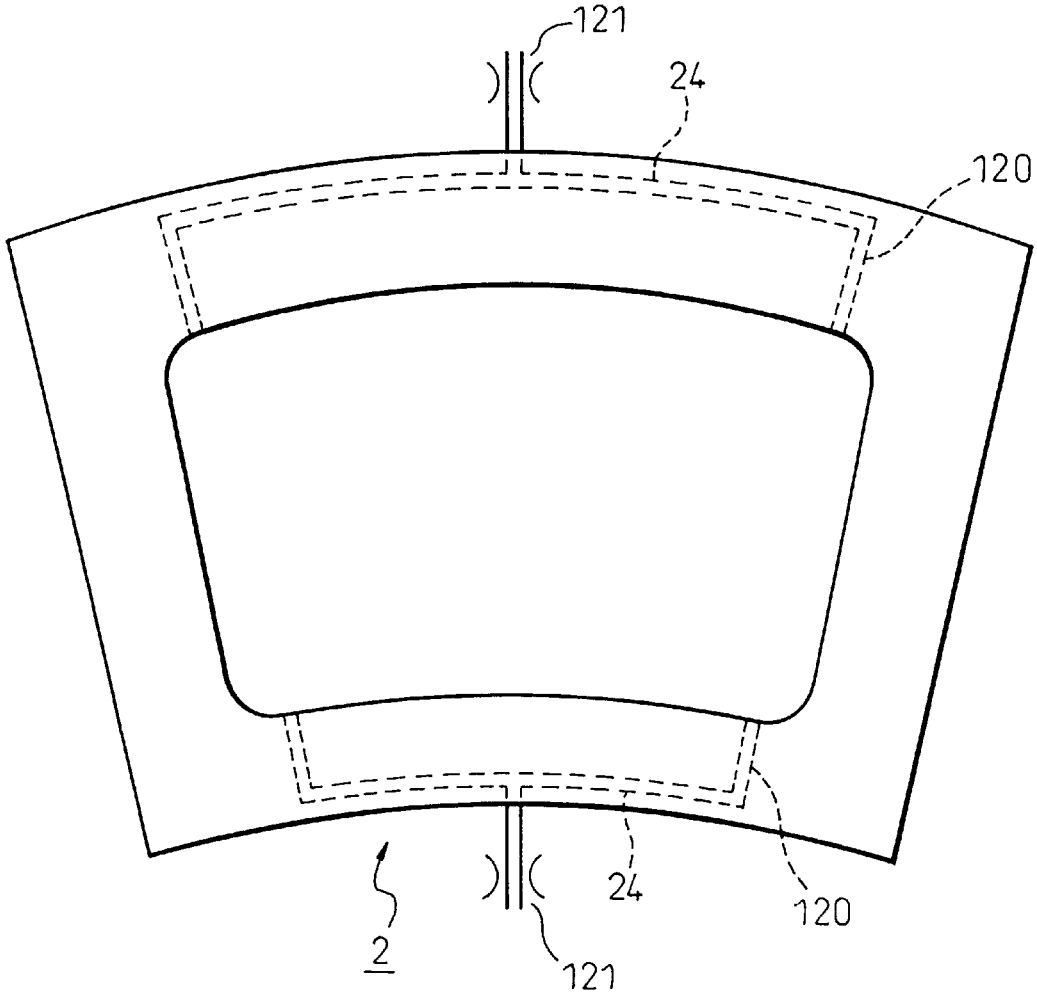
FIG. 11 is a structural view of an eighth embodiment.
Figure 12:
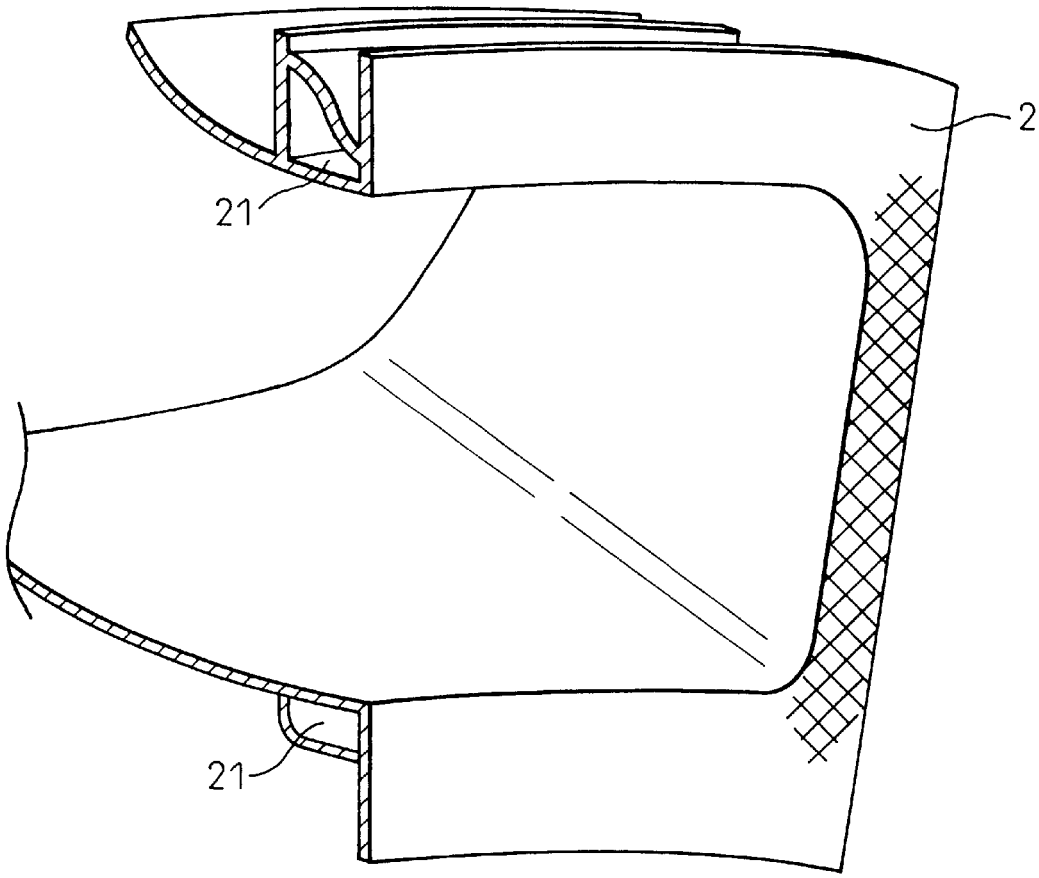
FIG. 12 is an enlarged view of a conventional flange part.

FIG. 11 is a structure view of an eighth embodiment of a transition piece outlet structure according to the present invention and shows the case of using combustion gas as the heating medium flowing through the channels 24 along the top and bottom surfaces of the flange 2.

That is, the channels 24 are connected to combustion gas intake channels 120 opening inside the flange 2 and discharge channels 121 led from the center of the channels 24 to the outside of the flange.

Therefore, part of the combustion gas flowing through the inside of the transition piece is taken from the combustion gas intake channels 120, flows through the channels 24 to heat the top and bottom surfaces of the flange, and is discharged from the discharge channels 121. Note that the flow rate of the combustion gas flowing through the channels 24 can be adjusted by orifices 122 provided in the discharge channels 121. Further, the discharged combustion gas may be discharged into the atmosphere or into the gas turbine combustion gas.

Further, it is also possible to lead the combustion gas from the combustion gas intake channels 110 to the outside once and inject air to reduce the temperature of the combustion gas.

Explaining the advantageous effects of the invention, according to the combustor transition piece outlet structure of the present invention, it becomes possible to reduce the temperature difference between the inside and outside of the outlet flange and thereby to extend the service life of the combustor.

Further, cracking due to thermal stress at the corners of the transition piece can be prevented and therefore the reliability of the combustor is improved.

Moreover, according to the gas turbine of the present invention, a net operating rate of the gas turbine is unproved and the gas turbine power plant can be effectively operated, because the reliability of the combustor is improved.

While the invention has been described with reference to specific embodiments chosen for purpose of illustration, it should be apparent that numerous modifications could be made thereto by those skilled in the art without departing from the basic concept and scope of the invention.

The present disclosure relates to subject matter contained in Japanese Patent Application No. 2001-040220, filed on Feb. 16, 2001, the disclosure of which is expressly incorporated herein by reference in its entirety.

What is claimed is:

1. A gas turbine combustor transition piece outlet structure, comprising:

a flange formed at an outlet of a gas turbine transition piece, wherein said flange has a side wall defining an inside volume of said gas turbine transition piece, and has a temperature difference reducing means for reducing a temperature difference between an inner circumference side and an outer circumference side of said flange, said flange extends substantially perpendicular to and outwardly from the side wall of the gas turbine transition piece, and said temperature difference reducing means is a channel formed in said flange to extend along said inner circumference of said flange and through which a cooling medium flows.

2. A gas turbine combuster transition piece outlet structure as set forth in claim 1, wherein the cooling medium flowing through said channel is compressed air introduced from a compressor outlet.

3. A gas turbine combuster transition piece outlet structure as set forth in claim 1, wherein the cooling medium flowing through said channel is steam supplied from a steam force.

4. A gas turbine combuster transition piece outlet structure as set forth in claim 1, wherein the cooling medium flowing through said channel is fuel supplied from a fuel tank.

5. A gas turbine combustor transition piece outlet structure, comprising:

a flange formed at a gas turbine transition piece outlet with a temperature reducing means for reducing a temperature difference between an inner circumference side and an outer circumference side of said flange, wherein said temperature difference reducing means is a channel formed along a facing surface of said flange with an adjoining flange and through which a cooling medium flows.

6. A gas turbine combustor transition piece outlet structure as set forth in claim 5, wherein the cooling medium flowing through said channel is pressurized air.

7. A gas turbine combustor transition piece outlet structure as set forth in claim 5, wherein the cooling medium flowing through the channel is steam heated after being supplied from a steam force.

8. A gas turbine combustor transition piece outlet structure as set forth in claim 5, wherein the cooling medium flowing through the channel is fuel supplied from a fuel tank.

9. A gas turbine combustor transition piece outlet structure, comprising:

a flange formed at a gas turbine transition piece outlet with a temperature reducing means for reducing a temperature difference between an inner circumference side and an outer circumference side of said flange, wherein said temperature difference reducing means is a channel formed along a facing surface of said flange not facing to an adjoining flange and through which a heating medium flows.

10. A gas turbine combustor transition piece outlet structure as set forth in claim 9, wherein the heating medium flowing through the channel is heated air.

11. A gas turbine combustor transition piece outlet structure as set forth in claim 9, wherein the heating medium flowing through the channel is combustion gas discharged from a turbine part.

12. A gas turbine combustor transition piece outlet structure as set forth in claim 9, wherein the heating medium flowing through the channel is combustion gas discharged from a turbine part and reduced in temperature by an attemporator.

13. A gas turbine combustor transition piece comprising:

an outlet structure as set forth in any one of claims 1 to 12.

14. A combustor of a gas turbine comprising:

a fuel injection nozzle; and a transition piece having an outlet structure as set forth in claim 13.

15. A gas turbine comprising:

an air compressor;

a combustor as set forth in claim 14, for combusting fuel with air compressed by said air compressor; and a turbine driven by combustion gas exhausted from said combustor.

* * * * *